United States Patent [19]

Salmi et al.

[11] 4,023,626

[45] May 17, 1977

[54] SELF-ADAPTIVE HYDRAULIC ROCK DRILL

[75] Inventors: Pekka Salmi; Rolf Strom, both of Tampere, Finland

[73] Assignee: Oy Tampella AB, Tampere, Finland

[22] Filed: June 18, 1975

[21] Appl. No.: 588,061

Related U.S. Application Data

[63] Continuation-in-part of Ser. No. 558,805, March 17, 1975, Pat. No. 3,979,944.

[52] U.S. Cl. ..... 173/8; 173/12

[51] Int. Cl.[2] ..... E21C 3/20

[58] Field of Search ..... 173/2, 10, 11, 12, 105, 173/115, 5, 4, 9; 91/412, 61, 170; 60/420

[56] References Cited

UNITED STATES PATENTS

| | | | |
|---|---|---|---|
| 3,186,103 | 6/1965 | Attebo et al. | 173/11 |
| 3,561,542 | 2/1971 | Hanson et al. | 173/5 |
| 3,670,826 | 6/1972 | Hanson et al. | 173/4 |
| 3,822,752 | 7/1974 | Montabert | 173/12 |
| 3,823,784 | 7/1974 | Feucht | 173/11 |

*Primary Examiner*—Ernest R. Purser
*Assistant Examiner*—William F. Pate, III
*Attorney, Agent, or Firm*—Hauke & Patalidis

[57] ABSTRACT

A hydraulic drill, more particularly a rock drill, having a self-adaptive servo control system comprising three separate but interdependent hydraulic circuits, one for operating and controlling the drill rotation motor, one for controlling and operating the drill impact unit and a third for operating and controlling the drill feed motor. Control valves are disposed in each hydraulic circuit and are automatically operated such that when the pressure in the rotation motor circuit increases beyond a predetermined limit, the pressure in the impact unit circuit is decreased so as to decrease the power of the impact unit, and when the pressure in the rotation motor circuit decreases below a predetermined limit, the pressure in the impact unit circuit is decreased so as to decrease the power of the impact unit, and also comprising a differential pressure valve in the feed motor circuit which controls the operation of the feed motor such that when the impact power is decreased, the feed is also decreased, and vice versa.

14 Claims, 2 Drawing Figures

SELF-ADAPTIVE HYDRAULIC ROCK DRILL

CROSS REFERENCE TO RELATED APPLICATION

The present application is a continuation-in-part of application Ser. No. 558,805 filed Mar. 17, 1975, assigned to the same assignee as the present application and now U.S. Pat. No. 3,979,944.

BACKGROUND OF THE INVENTION

The present invention relates to a hydraulic drill, more particularly a hydraulic rock drill, and relates more specifically to a self-adaptive servo control system for a hydraulic drill, such that the operation of the drill is automatically self-adjusted according to varying conditions encountered during a drilling operation.

In the course of a drilling operation in rocky ground, the material being drilled is often non-homogeneous, and layers of different hardness are often encountered, with the result that the drill bit penetration into the ground, under constant impact power and feed power, varies substantially according to the conditions encountered. This may cause the drill hole to become plugged and the drilling operation to stop. It is therefore common practice for a drill operator to observe the penetration of the drill bit into the ground and to manually control the impact and feed powers accordingly, which prevents a single operator from simultaneously managing the operation of several drill rigs.

It is known, as disclosed in French Pat. No. 2,129,276, for example, to connect the impact unit of a hydraulic drill in series with the drill rod rotating motor whereby, in the event of increase of the drill rod resistance to rotation the pressure drop across the rotation motor reduces the power of the impact unit in order to prevent the drill rod from seizing or stalling. However, when the drilling operation is started, and more particularly when the ground being drilled lacks homogenity, this arrangement operates in a manner exactly opposite to what would be desirable. As long as the drill bit is rotating freely or is engaged in soft ground, the impact power is at its maximum, although the impact power and feed power should both be low in order to feed the drill bit into the soft material with lower vernier feed.

The inconveniences and shortcomings of the prior art are overcome by the present invention which provides a hydraulic drill in which the operation of the three hydraulic circuits, namely the circuit controlling the operation of the impact unit, the circuit controlling the operation of the rotation motor, and the circuit controlling the operation of the feed motor, are made mutually dependent in such a manner that the operation of the drill is automatic for all practical purposes, and that a single operator is capable of supervising the simultaneous operation of several drill rigs.

SUMMARY OF THE INVENTION

The diverse objects and advantages of the present invention are obtained by providing a hydraulic drill, more particularly a rock drill, with a self-adaptive hydraulic servo system rendering the three principal hydraulic circuits of the drill mutually dependent such that the drill rod rotating motor acts as a sensing means and controls the impact unit to cause it to operate with higher or lower power, as the case may be, and also controls the drill rod feed motor through the reaction of the impact unit such that when the impact power decreases, the feed power also decreases. Furthermore, when the impact power decreases below a predetermined limit, the feed motor reverses its direction of rotation, with the result that the drill bit is automatically retracted.

A better understanding of the present invention will become apparent to those skilled in the art when the following description of the best mode contemplated for practicing the invention is read in conjunction with the accompanying drawing wherein:

DETAILED DESCRIPTION OF THE PREFERRED EMBODIMENT

Figure 1:
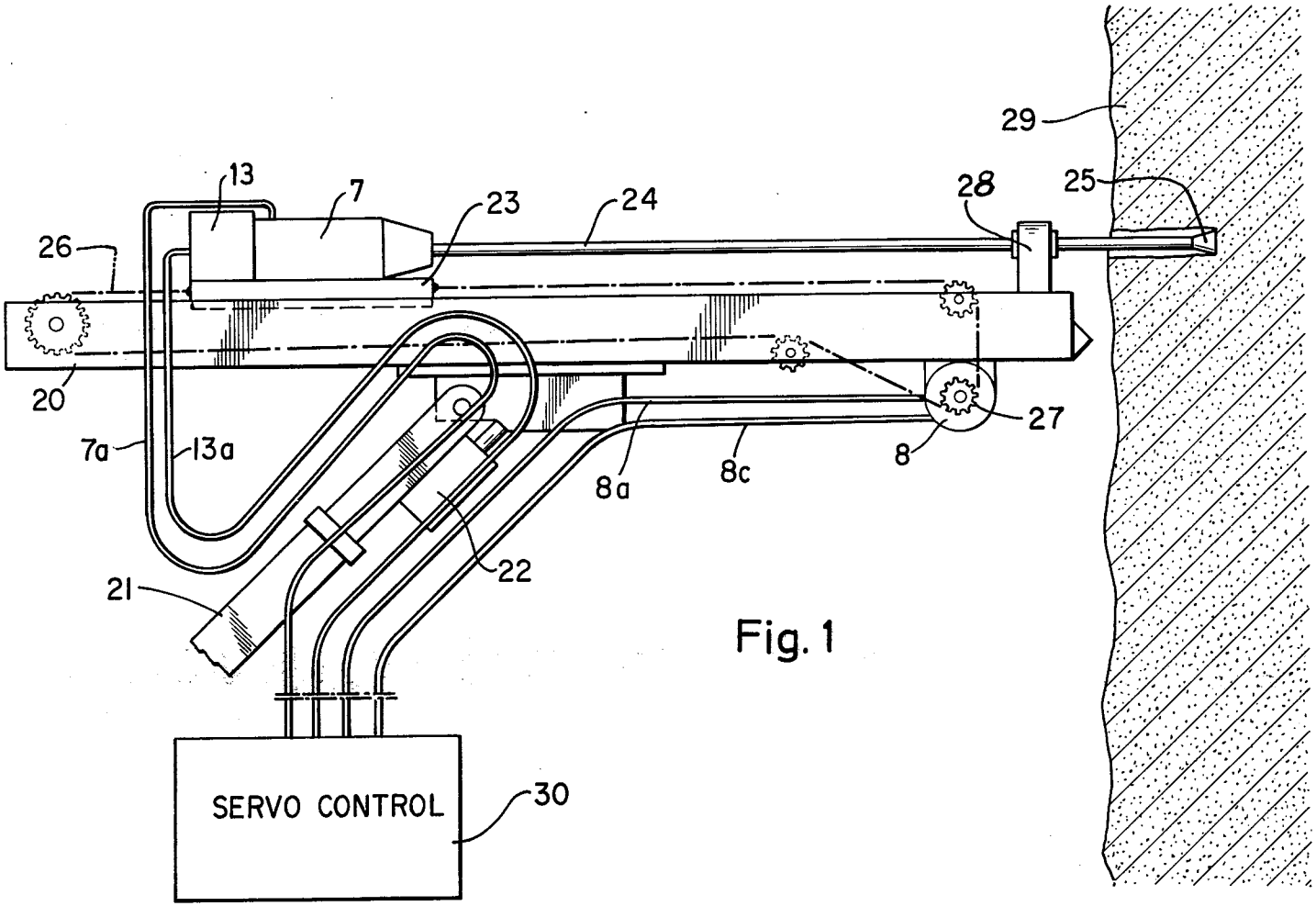
FIG. 1 is a schematic representation of a conventional hydraulic rock drill unit provided with a servo control system according to the invention.

Referring now to FIG. 1, there is illustrated a conventional hydraulic rock drill which, as is well known, comprises a frame 20 pivotally supported on the end of a support arm 21, normally fastened to a movable, generally self-propelled base, not shown. The frame 20 is orientable relative to the support arm 21 by means of a hydraulic or screw jack 22. A slide 23 supports a hydraulic rotation motor 13 and a hydraulic impact motor or unit 7 for a drill rod 24 provided on its end with a bit 25. The drill rod 24 is supported proximate the end of the frame 20 by a rotary and longitudinal bearing 28.

The slide 23 is reciprocable by way, for example, of a chain 26 wound about appropriate free rolling sprocket wheel and a driving sprocket wheel 27 affixed to the drive shaft of a hydraulic feed motor 8. According to the rotation of the feed motor 8, the drill rod and the drill bit 25 are thus fed into a material such as the ground or a vertical mine wall 29, or the like, for drilling holes therein. Hydraulic fluid under pressure is fed to the feed motor 8 by lines **8*a* or 8*c*, while hydraulic fluid under pressure is fed to the impact unit 7 and to the drill rotation motor 13 respectively by means of lines 7*a* and 13*a*. The direction and rate of flow and the pressure of the hydraulic fluid supplied to the three motors are under the control of the servo system 30** of the invention. For simplification of the representation of the invention, the return lines and the fluid reservoir are not illustrated at FIG. 1.

Figure 2:
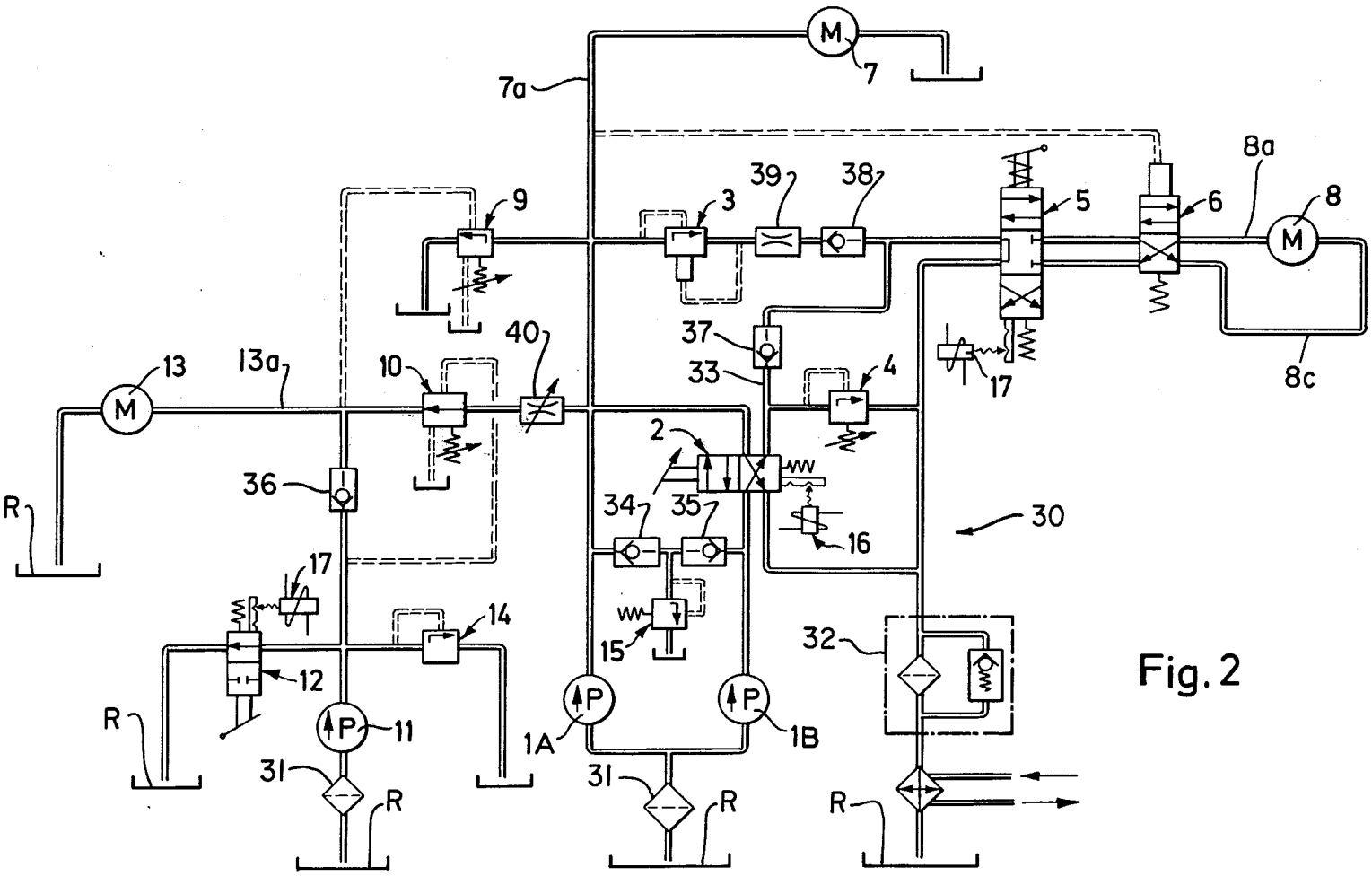
FIG. 2 is a hydraulic circuit diagram of the servo system of the present invention.

Referring now to FIG. 2, which shows in a schematic manner the details of the servo control system 30, the system comprises appropriate elements for regulating the flow and the pressure of the hydraulic fluid supplied to the feed motor 8 by means of lines **8*a* and 8*c*, to the impact unit 7 by means of the line 7*a* and to the drill drive motor 13 by way of the line 13*a***.

Hydraulic fluid is withdrawn from the hydraulic reservoir through a filter or strainer 31 by way of a pump 1B whose output is connectable by a directional valve 2 either to the circuit of the feed motor 8, in which case the speed of rotation of the feed motor 8 corresponds to high speed advance of the drill bit or, alternatively, to the line **7*a* leading to the impact unit 7, in which case the flow of fluid from the pump 1B is added to the normal flow of hydraulic fluid supplied to the impact unit which is normally obtained at the output of the pump 1A, while a small amount of hydraulic fluid is still supplied to the feed motor 8**.

By way of manual or electrical control, the desired mode of operation is selected by means of the valve 2. Such a mode of operation is the high speed traversing or feed mode, in which case only the hydraulic fluid flow at the output of the pump 1A is directed to the impact unit 7. Another mode of operation is when it is desired to use the output of both pumps 1A and 1B to provide a high flow rate and high pressure in the line *7a* leading to the impact unit 7. The valve 2 may also be operated manually, or by means of a pulse from a hydraulic or electric limit switch, so as to return the output of both pumps 1A and 1B to the fluid reservoir R through a strainer-bypass valve arrangement 32, thus stopping the operation of both the impact unit 7 and the feed motor 8.

When the directional valve 2 is operated to the position that directs the flow of fluid from the pump 1B to the feed motor 8 through the line 33 and the directional valve 5, the direction of rotation of the feed motor 8 is controlled by the valve 5 which is automatically or manually operable to direct the flow of fluid at its output either to line *8a* or to line *8c*. The directional valve 5 is also capable of being controlled either by manual or electric pulse means to a position which returns the flow of fluid to the fluid reservoir R, so as to stop the rotation of the feed motor 8.

The drill rotation motor 13 is fed in hydraulic fluid through the line *13a* by a pump 11 withdrawing the hydraulic fluid from the fluid reservoir through a strainer 31. A valve 12 by-passes the pump 11 and is operable manually or by electric control such that the output from the pump 11 is either returned to the fluid reservoir R, in which case the drill rotation motor 13 is stopped, or is directed through line *13a* into the drill rotation motor 13.

Pressure limiting valves, as illustrated at 4, 14 and 15 are connected at appropriate points on the diverse hydraulic circuits so as to limit the pressure prevailing in each circuit such that the maximum pressure in a circuit will not be exceeded. Also, at diverse points of the circuits check valves, as illustrated at 34, 35, 36, 37 and 38, are placed in the lines so as to prevent reverse fluid flow therethrough.

A pressure ratio valve 3 is connected between the line *7a* and the directional valve 5 through an appropriate calibrated orifice 39 insuring that the hydraulic fluid pressure in the circuit of the feed motor 8 remains at all times below a certain predetermined pressure level permissible for the feed motor, independently of the volume flow into the feed motor 8. During normal drilling operations, the pressure ratio valve 3 monitors the pressure of the fluid in line *7a* feeding the impact motor unit 7, and adjusts the pressure in the circuit of the feed motor 8 proportionally so that when the fluid pressure decreases in the line *7a*, there occurs a proportional drop of pressure of the fluid fed to the feed motor 8, thus causing a reduction of the drill feed in proportion to the reduction of the impact power, and vice versa.

A directional valve 6 is disposed between the directional valve 5 at the input of the circuit of the feed motor 8 and the lines *8a* and *8c* into the feed motor. The directional valve 6 also monitors the pressure in the line *7a* and is automatically operated in such manner that when the pressure in the line *7a* falls below a predetermined threshold value, the flow of fluid into the feed motor 8 normally effected through line *8a* is diverted to line *8c* such as to reverse the direction of rotation of the feed motor 8.

A flow control valve 9 is connected to the line *7a*, and is adapted to be operated by the pressure of the fluid in the line *13a* connecting the output of a pump 11 to the rotation motor 13. When the pressure in line *13a* rises above a predetermined threshold value, the flow control valve 9 opens so as to dump part of the fluid in line *7a* to return, thus causing a pressure drop in line *7a*. As a result, the power of the impact unit 7 is decreased and, under the action of the pressure ratio valve 3, the pressure level into the feed motor 8 is also decreased. When the pressure falls below a certain predetermined level, the directional valve 6 is operated so as to reverse the direction of fluid into the feed motor 8.

A flow control valve 10 is connected between the line *13a* and the line *7a*, an adjustable orifice 40 being connected between the valve 10 and the line *7a*. When the pressure in the line *13a* falls below a threshold value corresponding to normal drilling, the flow control valve 10 is operated to withdraw pressurized fluid from the line *7a*, and thereby lower the pressure in line *7a*. The impact power of the impact unit 7 is thus decreased and, consequently, the speed of the feed motor 8 is also decreased. This action is of importance especially when a new hole drilling is started, in which case the output of the pump 11 is returned to the reservoir R by way of the valve 12.

The depth of the hole drilled, or maximum advance of the drill bit, is determined by a limit switch 16 tripped by the slide 23 (FIG. 1). The limit switch 16 is arranged to control the valve 2 to a mode releasing the fluid pressure in the line *7a*. The drop of pressure in the line *7a* causes the directional valve 6 to be operated such as to reverse the direction of fluid flow through the feed motor 8, thus causing the feed motor 8 to reverse and start the return feed of the drill rod. Simultaneously therewith, the valve 2 is also in a position causing the fluid supplied by the pump 1B to bypass the ratio valve 3, by connecting the output of the pump 1B directly to the line 33, thus resulting in directing pressurized fluid directly to the motor 8 for rapid retraction of the drill bit.

At the end of the return stroke of the slide 23 (FIG. 1), a limit switch 17 is tripped which in turn operates the valve 5 to its center or neutral position, thus stopping the feed motor 8. The limit switch 17 simultaneously operates the valve 12, to a position dumping the fluid supplied by the pump 11 to return to the reservoir, thus stopping the rotation motor 13. The drill is thus ready to start another drilling cycle.

It can thus been seen that the hydraulic servo system of the invention provides a control for a hydraulic drill which is completely automatic after the drilling operation is manually started, without any risk of damage to the drill bit when the drilling is started and holes are being drilled in rocks and other materials. In addition, it is possible to non-linearly regulate, as desired, the ratio of the rotation power and impact power of the drill.

Having thus described the present invention by way of a typical embodiment thereof, modifications whereof will be apparent to those skilled in the art,

What is claimed as new is as follows:

1. A servo system for a hydraulic drill comprising a first circuit supplying pressurized fluid to a drill impact unit, a second circuit providing pressurized hydraulic fluid flow to a drill rotation motor and a third circuit providing fluid flow to a feed motor for advancing or retracting the drill, said servo system comprising separate pumps for supplying pressurized fluid flow to each of said circuits, a first valve shunting said impact unit circuit and operating as a function of the pressure of the fluid in said rotation motor circuit in such manner that when the pressure in said rotation motor circuit increases beyond a predetermined value said first valve release flow from said impact unit circuit for lowering the pressure therein to cause the power of said impact unit to be decreased, a second valve controlled as a function of the pressure in said rotation motor circuit such that when the pressure therein falls between a predetermined value said second valve is opened to release flow from said impact unit circuit for lowering the pressure therein whereby the power of said impact unit is decreased, and a third valve disposed in said feed motor circuit controlled by the pressure variations in said impact unit circuit in such manner than when the pressure in said impact unit circuit decreases the fluid flow to said feed motor is decreased and when the pressure in said impact unit circuit is increased the fluid flow to said feed motor is increased, wherein said feed motor circuit is connected to said impact unit circuit by means of a pressure ratio valve controlling the fluid flow into said feed motor as a function of the pressure variations in said impact unit circuit.

2. a hydraulic drill according to claim 1 wherein a directional valve is disposed in said feed motor circuit, said directional valve being controlled as a function of the pressure in said impact unit circuit such that when said pressure falls below a predetermined value, the fluid flow through said feed motor is reversed.

3. A hydraulic drill according to claim 2 wherein said directional valve in said impact unit circuit is further controlled by a depth of hole limit switch determining the limit of advance of the drill such that when said valve is switched to cause said fluid to bypass said pressure ratio valve and be fed directly to said feed motor, the pressure of said impact unit circuit is released thus causing said directional valve to operate to cause reversal of said feed motor.

4. a hydraulic drill according to claim 1 wherein a directional valve is disposed in said feed motor circuit, said directional valve being manually or electrically controlled for reversing the direction of rotation of said feed motor.

5. a hydraulic drill according to claim 4 wherein said directional valve is operable by a drill retraction limit switch for stopping said feed motor upon retraction of said drill.

6. A hydraulic drill according to claim 1 further comprising a valve for manually or electrically switching the output of the pump feeding said rotation motor to a fluid return circuit for stopping said rotation motor.

7. A hydraulic drill according to claim 6 wherein said last mentioned valve is controlled by a drill retraction limit switch for switching the output of said pump feeding said rotation motor to a fluid return circuit for stopping said rotation motor upon retraction of the drill.

8. A hydraulic drill accordding to claim 5 wherein said drill retraction limit switch operates a valve switching the output of the pump feeding said rotation motor to a fluid return circuit or simultaneously stopping said rotation motor.

9. A servo system for a hydraulic drill comprising a first circuit supplying pressurized fluid to a drill impact unit, a second circuit providing pressurized hydraulic fluiid flow to a drill rotation motor and a third circuit providing fluid flow to a feed motor for advancing or retracting the drill, said servo system comprising separate pumps for supplying pressurized fluid flow to each of said circuits, and a valve means disposed in said feed motor circuit, said valve means responsive to the pressure variations in said impact unit circuit said valve means operating in such manner that when the pressure in said impact unit circuit decreases, the fluid flow to said feed motor is decreased and when the pressure in said impact unit circuit is increased, the fluid flow to said feed motor is increased.

10. A hydraulic drill according to claim 9 wherein said rotation motor circuit is connected to said impact unit circuit by means of a pressure ratio valve controlling the fluid flow into said feed motor as a function of the pressure variations in said impact unit circuit.

11. A hydraulic drill according to claim 9 wherein a directional valve is disposed in said feed motor circuit, said directional valve being controlled as a function of the pressure in said impact unit circuit such that when said pressure falls below a predetermined value, the fluid flow through said feed motor is reversed.

12. A hydraulic drill according to claim 11 wherein said directional valve in said impact unit circuit is further controlled by a depth of hole limit switch determining the limit of advance of the drill such that when said directional valve is switched to cause said fluid to bypass said pressure ratio valve and be fed directly to said feed motor, the pressure of said impact unit circuit is released thus causing said directional valve to operate to cause reversal of said feed motor.

13. A hydraulic drill according to claim 9 wherein a directional valve is disposed in said feed motor circuit, said directional valve being manually or electrically controlled for reversing the direction of rotation of said feed motor.

14. a hydraulic drill according to claim 13 wherein said directional valve is operable by a drill retraction limit switch for stopping said feed motor upon retraction of said drill.

* * * * *